US012252305B2

(12) United States Patent
McLeod

(10) Patent No.: US 12,252,305 B2
(45) Date of Patent: Mar. 18, 2025

(54) CORNER CONFIGURATIONS FOR TRAY CONTAINERS

(71) Applicant: WESTROCK SHARED SERVICES, LLC, Atlanta, GA (US)

(72) Inventor: Michael McLeod, Romeoville, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/684,784

(22) Filed: Mar. 2, 2022

(65) Prior Publication Data

US 2023/0278747 A1 Sep. 7, 2023

(51) Int. Cl.
*B65D 5/42* (2006.01)
*B65D 5/00* (2006.01)
*B65D 5/28* (2006.01)

(52) U.S. Cl.
CPC ..... *B65D 5/0015* (2013.01); *B65D 5/28* (2013.01); *B65D 5/4266* (2013.01)

(58) Field of Classification Search
CPC ..... B65D 5/4266; B65D 5/0015; B65D 5/28; B65D 5/443
USPC ..... 229/122.32, 165, 170, 172, 181, 182, 229/190, 198, 915, 979, 918, 930–931
See application file for complete search history.

(56) References Cited

U.S. PATENT DOCUMENTS 3,727,827 A * 4/1973 Stice ..... B65D 5/0005 229/101
3,940,053 A * 2/1976 Putman ..... B65D 5/0035 229/176
4,134,533 A 1/1979 Heavner
4,601,407 A * 7/1986 Gillard ..... B65D 3/22 229/930
4,693,413 A * 9/1987 McFarland ..... B65D 5/4266 229/930
4,702,409 A * 10/1987 Osborne ..... B65D 5/003 229/125
5,516,034 A 5/1996 Jensen et al.
5,860,590 A * 1/1999 Blomfield ..... B65D 5/443 229/165
6,443,358 B1 * 9/2002 Schilling ..... B65D 5/443 206/509
8,079,474 B1 * 12/2011 Flaming ..... B65D 5/443 206/509
9,156,578 B2 * 10/2015 Smith ..... B65D 1/225
10,633,140 B1 * 4/2020 Vergara ..... B65D 5/4266
(Continued)

*Primary Examiner* — Nathan J Newhouse
*Assistant Examiner* — Phillip D Schmidt
(74) *Attorney, Agent, or Firm* — Neil G. Cohen; Rohini K. Garg

(57) ABSTRACT

A blank for forming a container includes a base having a first pair of opposed base edges and a second pair of opposed base edges. Two sidewall structures are each foldably attached to one of the second base edges. Each of the sidewall structures includes a first wall panel foldably attached to one of the second base edges along a first fold line, a second wall panel foldably attached to the first wall panel configured to be overlapped with the first wall panel to form a side wall. A second minor end flap is foldably attached by a crushed channel to the second side wall panel, and extends in the lateral direction from the second side wall panel. The second minor end flap is configured to overlap a first minor end flap in forming a corner of a container formed from the blank.

21 Claims, 5 Drawing Sheets

(56) References Cited

U.S. PATENT DOCUMENTS

| | | | | |
|---|---|---|---|---|
| 2009/0272789 | A1* | 11/2009 | Fry | B65D 5/0015 229/5.5 |
| 2013/0048704 | A1* | 2/2013 | Lewis | B65D 5/0015 229/190 |
| 2021/0284377 | A1* | 9/2021 | Couture | B65D 5/4608 |

* cited by examiner

CORNER CONFIGURATIONS FOR TRAY CONTAINERS

BACKGROUND

1. Field

The present disclosure relates to containers for packaging product, and more particularly to corner structures that provide strength to the containers for stacking multiple containers.

2. Description of Related Art

Various designs exist for forming tray-like containers from corrugated paper material. Such containers can be used to hold product such as produce. It can be advantageous to stack multiple filled containers, one on top of the other, to transport the product and/or to save space in a retail setting. The weight of the product can crush the lower containers, and in particular the corners can be a place of failure when a stack of containers fails.

The conventional techniques have been considered satisfactory for their intended purpose. However, there is an ever present need for improved systems and methods for improved corner structures for containers. This disclosure provides a solution for this need.

SUMMARY

A blank for forming a container includes a base having a first pair of opposed base edges and a second pair of opposed base edges. Two first sidewall structures are each foldably attached to one of the first base edges. Two second sidewall structures are each foldably attached to one of the second base edges. Each of the second sidewall structures includes a first wall panel foldably attached to one of the second base edges along a first fold line, a second wall panel foldably attached to the first wall panel configured to be overlapped with the first wall panel to form a side wall, and a first minor end flap foldably attached to the first wall panel extending in a lateral direction from the first side wall panel. A second minor end flap is foldably attached to the second side wall panel extending in the lateral direction from the second side wall panel, configured to overlap the first minor end flap and one of the first sidewall structures in forming a corner of a container formed from the blank. The second minor end flap is foldably attached to the second side wall panel by a crushed channel.

The crushed channel can be devoid of die cut outs, perforations, slits, fold lines, score lines, or lines of weakness beyond the crushed state of the crushed channel itself. An adhesive can be adhered to the first wall panel and first minor end flap. The second wall panel can be folded over and adhered by the adhesive to the first wall panel. The second minor end flap can be adhered to the first minor end flap. The crushed channel can be adhered to at least one of the first minor end flap and the first wall panel.

The second wall panel can include at least one index flap defined therein. At least one indexing aperture can be defined in the base aligned with the at least one index flap for stacking. The first and second minor end flaps can be attached to one another by a frangible connection configured to maintain contact between the first and second minor end flaps for at least a portion of an erecting process forming the blank into a container. The first and second minor end flaps can be attached to one another by a crushed portion.

The first and second wall panels can be foldably attached across a line that includes at least one slit portion and at least one crushed portion. The first and second wall panels can be foldably attached across a line of alternating slit portions and crushed portions. The crushed portions can extend in a crushed portion length direction and have a crushed portion width in a lateral direction relative to the crushed portion length direction. The crushed channel can extend along a crushed channel length and can have a crushed channel width lateral relative to the crushed channel length. The crushed channel width can be wider than the crushed portion width.

The base, first sidewall structures, and second sidewall structures can all be defined in a sheet of corrugated paper having a corrugated thickness and including at least one corrugated layer of paper material, an inner layer of paper material, and an outer layer of paper material. In the crushed channel, the layers of paper material can be compacted together to a crushed thickness that is thinner than the corrugated thickness. The sheet of corrugated paper can define at least one fold line. The fold line can extend along a fold line length and a fold line width can be defined in a direction lateral to the fold line length. The crushed channel can defines a crushed channel length and a crushed channel width that is defined in a direction lateral to the crushed channel length. The crushed channel width can be wider than the fold line width.

A container can be formed of a blank as described above so the first sidewall structures and second sidewall structures define border that cooperates with the base to define an interior space configured for receiving product. The second minor end flap can be foldably attached to the second side wall panel extending in the lateral direction from the second side wall panel, overlapping the first minor end flap and one of the first sidewall structures to define a corner of the boarder.

The second wall panel can be folded over and adhered by the adhesive to the first wall panel. The second minor end flap can be adhered to the first minor end flap. The crushed channel can be adhered to at least one of the first minor end flap and the first wall panel. The first and second minor end flaps can be overlapped with and adhered to one of the first side wall structures. The second wall panel can include at least one index flap defined therein adhered to the first wall panel and extending proud of the first wall panel relative to the base. At least one indexing aperture can be defined in the base aligned with the at least one index flap for stacking multiples of containers as described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
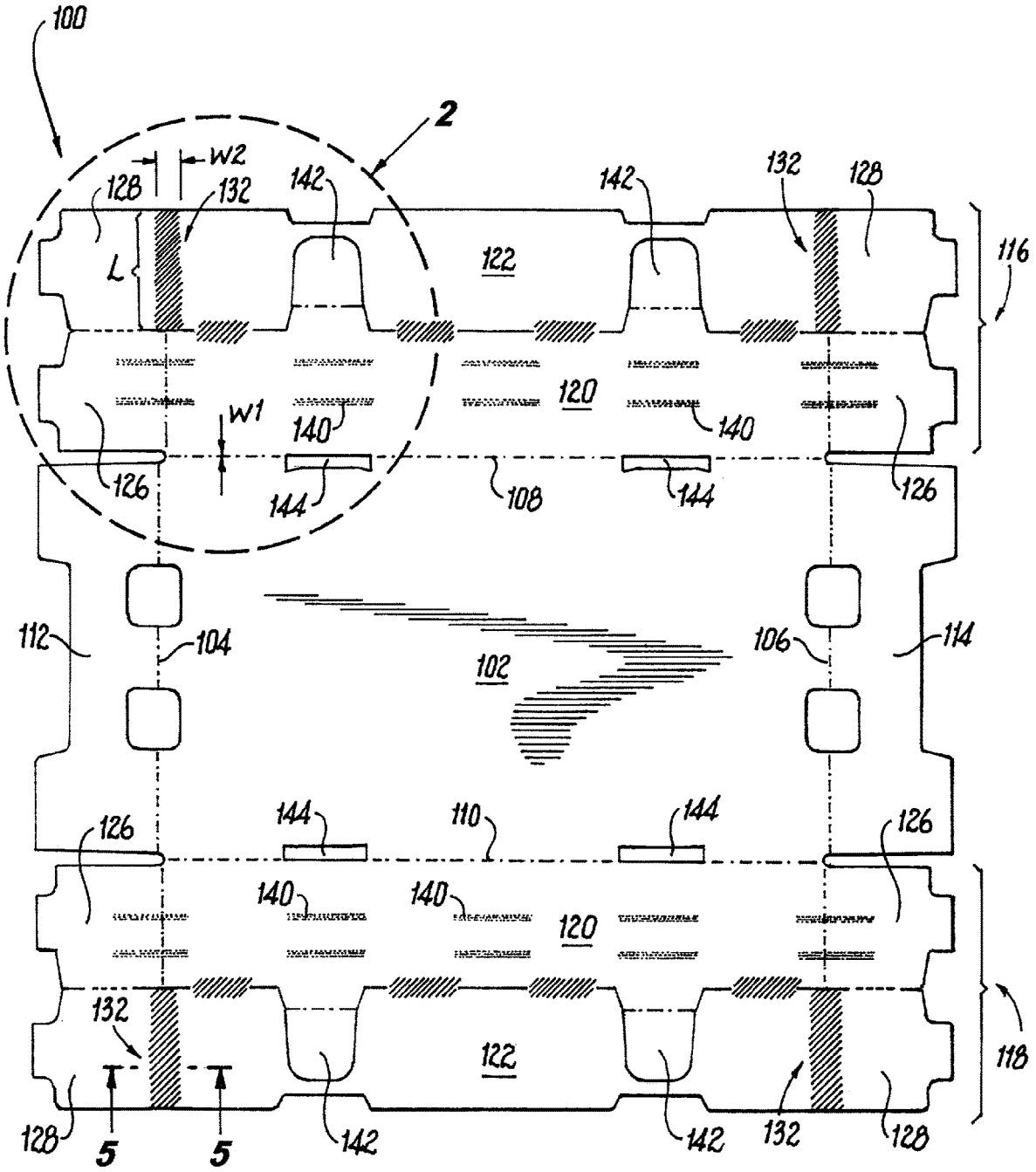
FIG. 1 is a plan view of an embodiment of a blank for a stackable container constructed in accordance with the present disclosure, showing the crush channels.

Reference will now be made to the drawings wherein like reference numerals identify similar structural features or aspects of the subject disclosure. For purposes of explanation and illustration, and not limitation, a partial view of an embodiment of a blank in accordance with the disclosure is shown in FIG. 1 and is designated generally by reference character 100. Other embodiments of systems in accordance with the disclosure, or aspects thereof, are provided in FIGS. 2-7, as will be described. The systems and methods described herein can be used to provide stackable containers with strong corners for improved resistance to failure when stacking relative to traditional corner configurations.

The blank 100 for forming a stackable container 101 (shown in FIG. 7) includes a base 102 having a first pair of opposed base edges 104, 106 and a second pair of opposed base edges 108, 110. Two first sidewall structures 112, 114 are each foldably attached to one of the first base edges 104, 106, respectively. Two second sidewall structures 116, 118 are each foldably attached to one of the second base edges 108, 110, respectively.

Each of the second sidewall structures 116, 118 includes a first wall panel 120 foldably attached to one of the second base edges 108, 110 along a first fold line, which lies along its respective base edge 108, 110. A respective second wall panel 122 is foldably attached to each first wall panel 120 configured to be overlapped with the respective first wall panel 120 to form a respective side wall 124 (labeled in FIG. 7).

A respective first minor end flap 126 is foldably attached to each end of each of the first wall panels 120 (for a total of four minor end flaps 126) extending in a lateral direction from its respective first side wall panel 120. A second minor end flap 128 is foldably attached to each end of each of the second side wall panels 120, extending in the lateral direction from its respective second side wall panel 122. There are at total of four minor end flaps 126 and four minor end flaps 128. The minor end flaps 128 are configured to overlap the first minor end flaps 126, respectively, and a proximate one of the first sidewall structures 112, 114 in forming a corner 130 (labeled in FIG. 7) of a container 101 formed from the blank 100.

Each second minor end flap 128 is foldably attached to the respective second side wall panel 122 by a respective crushed channel 132. The crushed channels 132 are devoid of die cut outs, perforations, slits, fold lines, score lines, or lines of weakness beyond the crushed state of the crushed channel 132 itself.

The base 102, first sidewall structures 112, 114, and second sidewall structures 116, 118 are all defined in a sheet of corrugated paper. As shown in the schematic cross-section of FIG. 5, the sheet of corrugated paper has a corrugated thickness T and includes at least one corrugated layer 134 of paper material, an inner layer 136 of paper material, and an outer layer 138 of paper material. In the crushed channel 132, the layers 134, 136, 138 of paper material are compacted together to a crushed thickness t that is thinner than the corrugated thickness T. The crushed channels 132 can be formed in the corrugated paper by any suitable process such as by crushing the blank 100 with appropriately shaped crush bars made of hard rubber, cork, metal, or any other suitable material, pressing the blank against an underlying anvil or the like. Those skilled in the art will readily appreciate that while shown as an example with three layers 134, 136, 138 (referred to as "single wall"), any other suitable ply configuration can be used, such as double wall, where there are three flat facing layers, one inside, one outside, and one between two corrugated layers.

With reference again to FIG. 1, the sheet of corrugated paper of blank 100 defines at least one fold line, e.g. the fold lines of edges 104, 106, 108, 110. The fold line extends along a fold line length and fold line width W1 is defined in a direction lateral to the fold line length. The fold line width W1 is labeled in FIG. 1 for the fold line of edge 108. The crushed channels 132 define a crushed channel length L and a crushed channel width W2 is defined in a direction lateral to the crushed channel length L. The crushed channel length L and width W2 are labeled fore one of the crushed channels 132 in FIG. 1. The crushed channel width W2 is wider than the fold line width W1.

An adhesive 140 (some, but not all of which are labeled in FIG. 1 for sake of clarity) is adhered to the first wall panels 120 and first minor end flaps 126. In forming the container 101 shown in FIG. 7, the second wall panels 122 are folded over and adhered by the adhesive 140 to their respective first wall panel 120. Each second minor end flap 128 is adhered to its respective first minor end flap 126 by this same folding action. Each of the crushed channels 132 is adhered to the first minor end flap 126 and the first wall panel 120.

With continued reference to FIG. 1 the second wall panel 122 includes at least one index flap 142 defined therein. At least one indexing aperture 144 is defined in the base 102 aligned with the respective index flap 142 for stacking multiple ones of the finished containers 101 shown in FIG. 7. Apertures 144 and index flaps 142 are optional.

Figure 2:
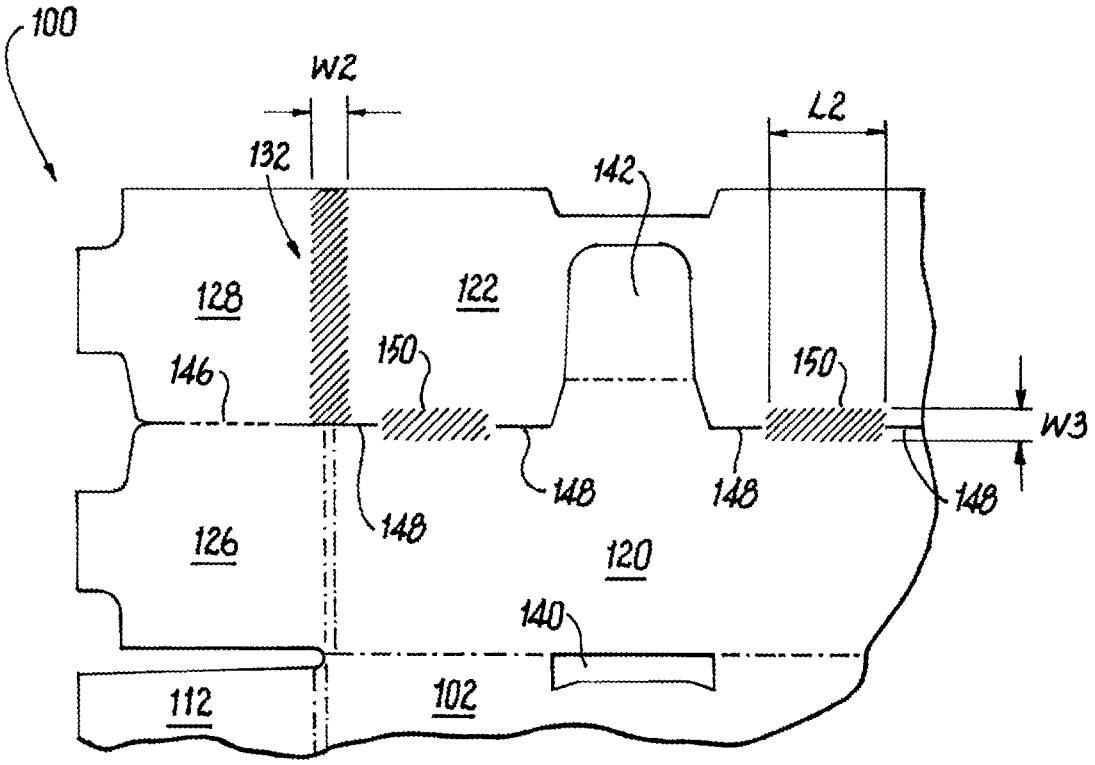
FIG. 2 is a plan view of a portion of the blank of FIG. 1, showing the connection between the minor flaps.

With reference now to FIG. 2 the first and second minor end flaps 126, 128 are attached to one another by a frangible connection 146, such as a perforation configured to maintain contact or attachment between the first and second minor end flaps 126, 128 for at least a portion of an erecting process forming the blank into a container to facilitate the process. The process of erecting the container may ultimately break the frangible connection 146.

Figure 3:
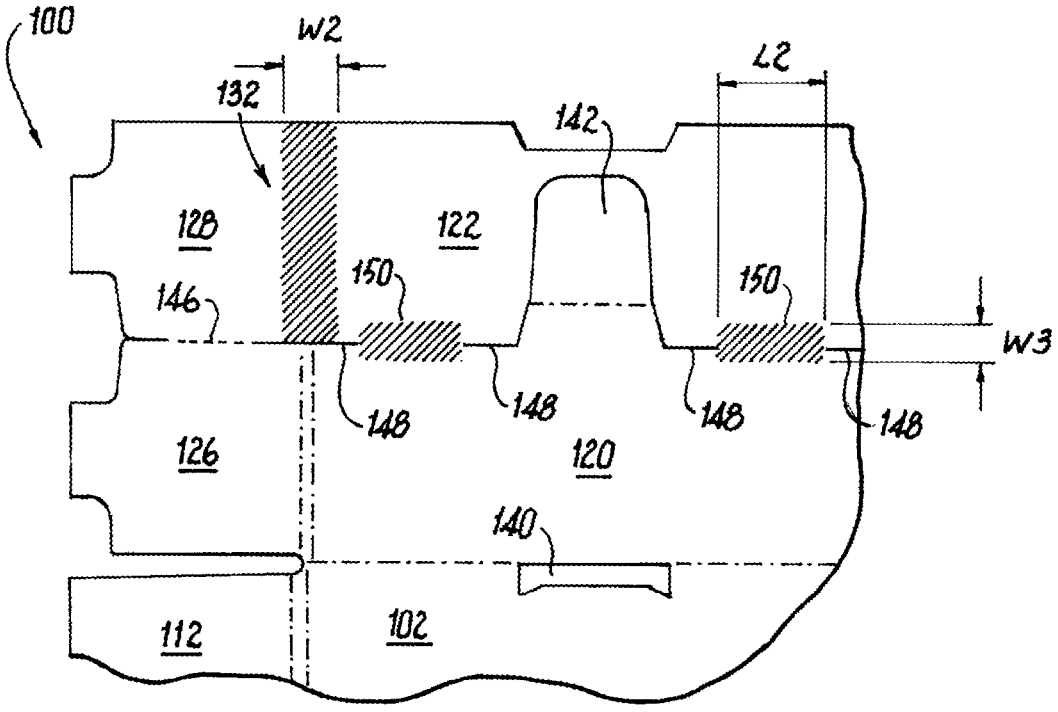
FIG. 3 is a plan view of a portion of the blank of FIG. 1, showing a variation in the minor flaps.
Figure 4:
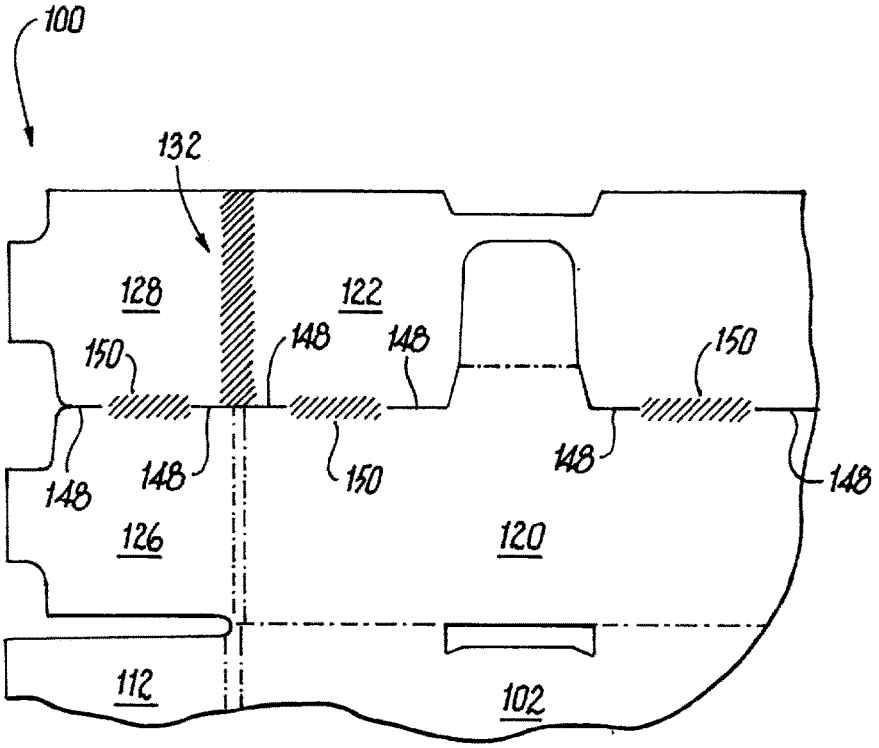
FIG. 4 is a plan view of a portion of the blank of FIG. 1, showing a variation in the connection between the minor flaps.
Figure 5:
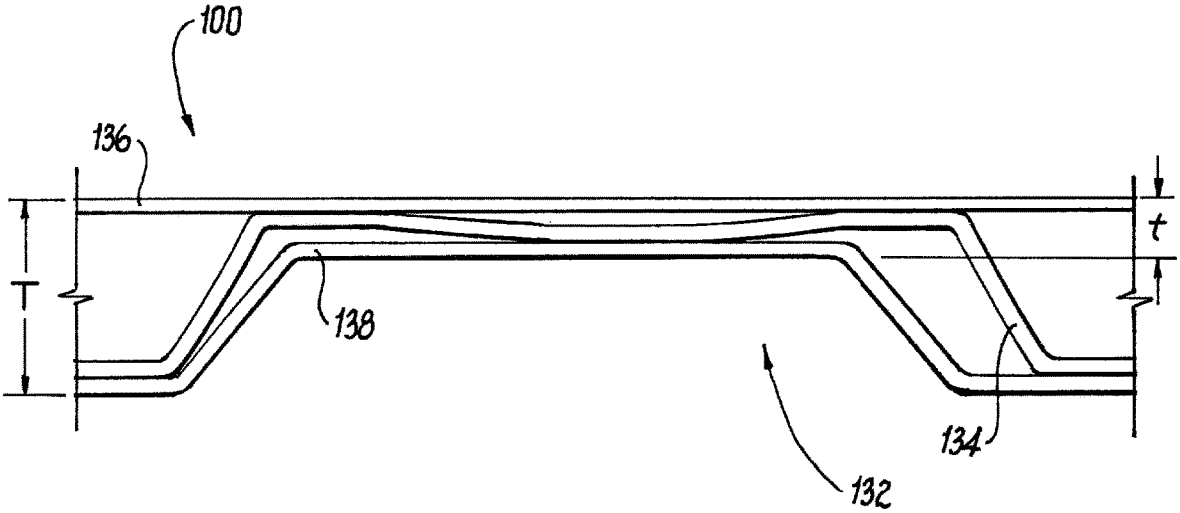
FIG. 5 is a schematic cross-sectional elevation view of a portion of the blank of FIG. 1, showing the thickness of the corrugated material, and the thickness of one of the crushed channels.

The first and second wall panels 120, 122 are foldably attached across a line of alternating slit portions 148 and crushed portions 150. The crushed portions 150 extend in a crushed portion length L2 direction and have a crushed portion width W3 in a lateral direction relative to the crushed portion length direction of L2. In FIGS. 1, 2, and 4, the crushed channels 132 have a width W2 that is wider than the width W3 of the crushed portions 150. In FIG. 3, an extended width crush channel is used, where the crushed channel width W2 is wider than the crushed portion width W3. W2 in FIG. 3 can be up to four times the caliper of the material of the blank 100. W3 should be roughly the caliper of the material, e.g. corrugated paper, of the blank, or even wider, so that after crushing, the crushed channel 132/ crushed portion 150 will behave like a ribbon. As shown in FIG. 4, it is also possible to replace the frangible connection 146 with an crushed portion 150 and slit portions 148, to continue the alternating pattern of slit portions 108 and crushed portions 150 between the wall panels 120, 122.

Figure 6:
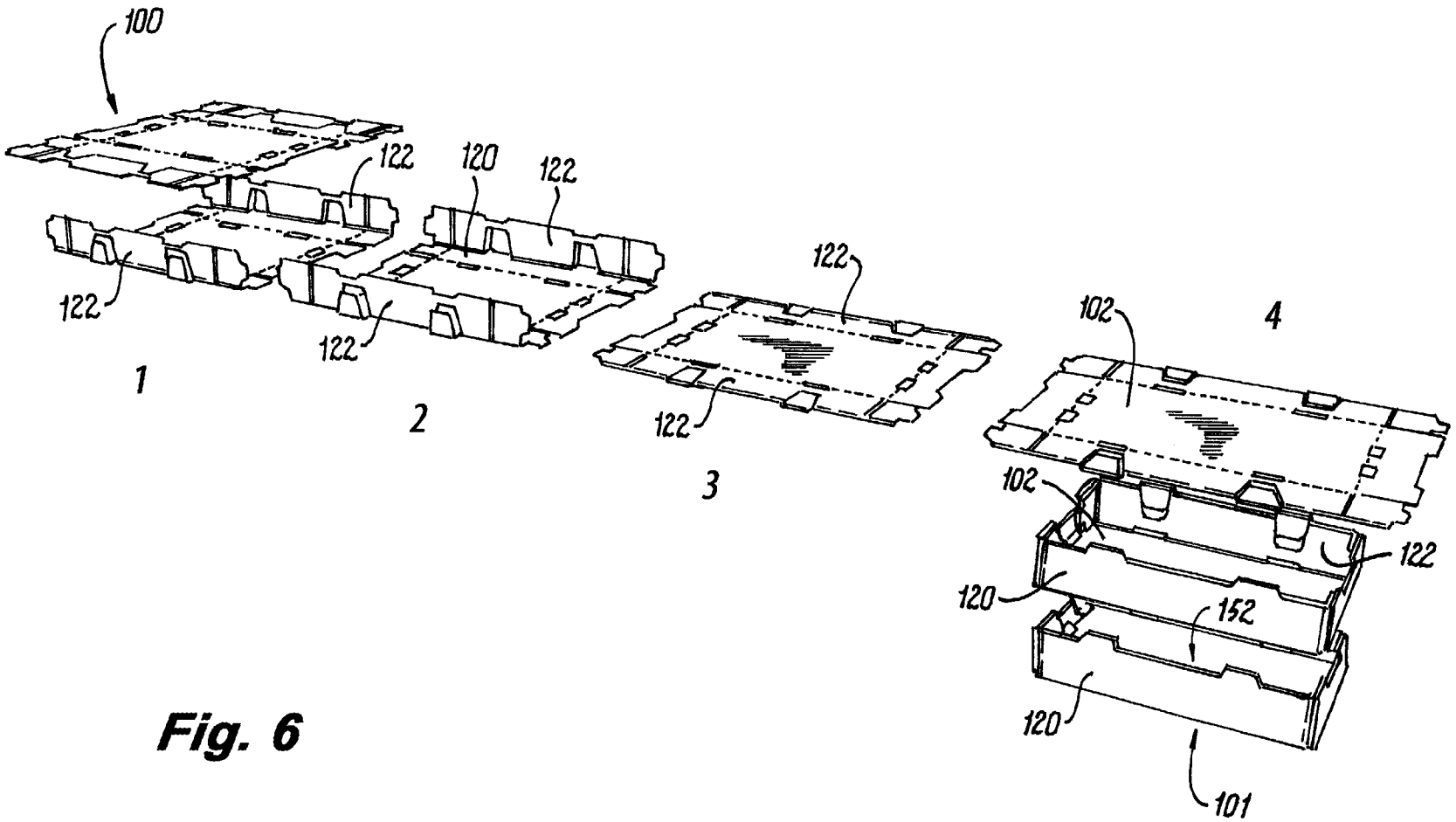
FIG. 6 is a schematic perspective view of the blank of FIG. 1, showing stages of forming the blank into a container.
Figure 7:
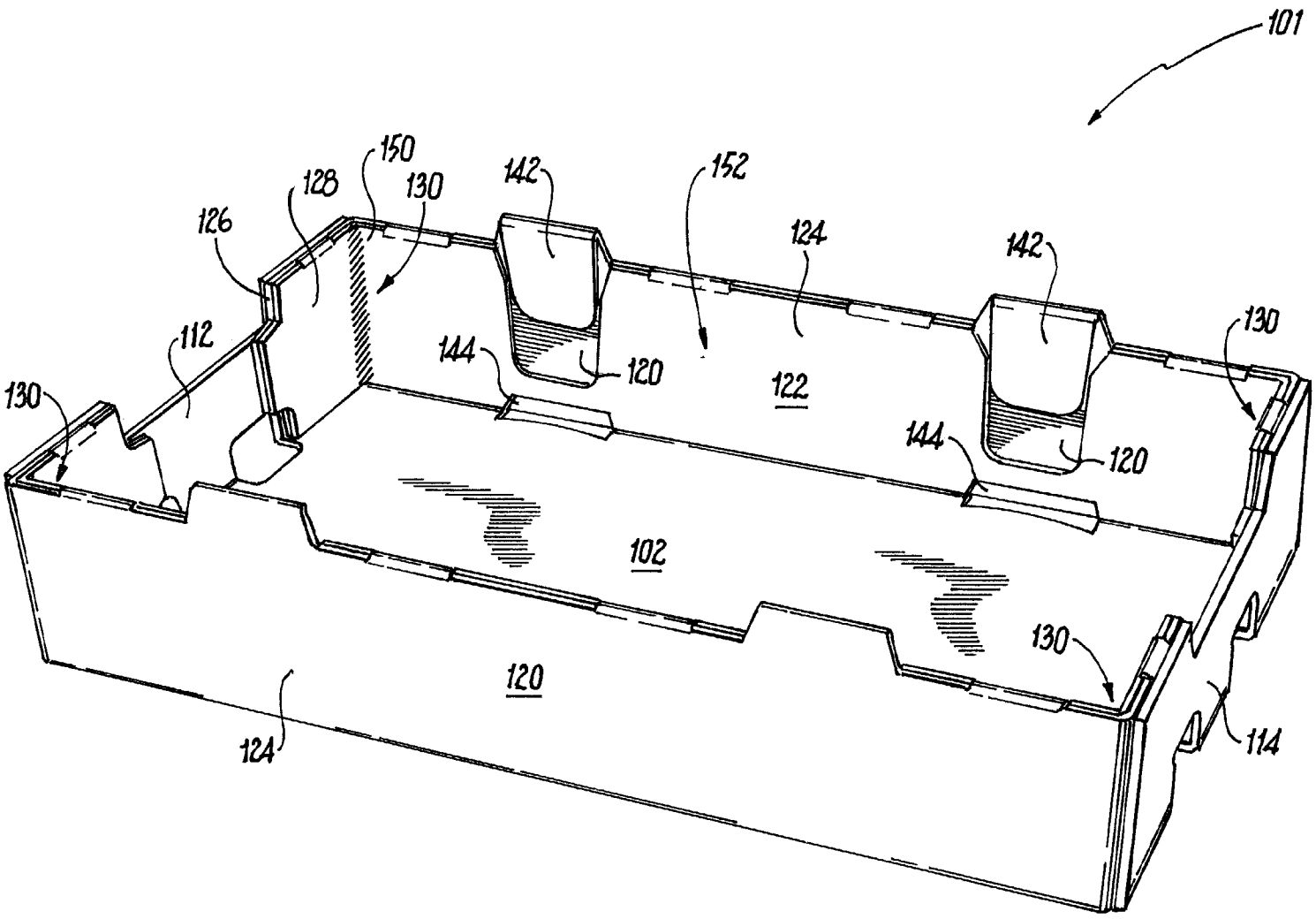
FIG. 7 is a perspective view of the container of FIG. 6.

With reference now to FIG. 6, the blank 100 of FIG. 1 can be erected into the container 101 of FIG. 7. An erector machine can fold the second wall panels 122 upward as indicated at folding station 1 of FIG. 6. If the adhesive 140 (labeled in FIG. 1) is not already applied, it can be applied at station 2 of FIG. 6, e.g. after moving away from the first folding station 1. At station 3, the second wall panels 122 are folded all the way down onto the first wall panels 120 and adhered thereto. At station 4, a mandrel or piston can push down (as oriented in FIG. 6) on the base 102, folding the first and second sidewall structures 112, 114 and 116, 116 (all labeled in FIG. 1) upward to define a border that cooperates with the base 120 to define an interior space 152 configured for receiving product.

With reference again to FIG. 7, each second minor end flap 128 (labeled in FIG. 1) overlapped with and adhered to the respective first minor end flap 126 and one of the first sidewall structures 112, 114 to define a corner 130 of the border around the interior space 152, with the combined first and second minor end flaps 126, 128 inside the respective sidewall structure 112, 114. The second wall panel 122 includes at least one index flap 142 defined therein, which in the container 101 is adhered to the first wall panel 120. The index flaps 142 extend proud of the first wall panels 120 relative to the base 102. The crushed channel 132 is adhered to at least one of the first minor end flap 126 and the first wall panel 120, wherein the adhesive and layers of panels 120, 122, flaps 122, 128, and respective sidewall structures 112, 114 lend considerable strength to the corners 130 of the container 100. Multiple containers 100 can be stacked on top of one another with reduced potential for corner failure when compared to traditional configurations.

While shown and described herein in the exemplary context of stackable tray-type containers, those skilled in the art having had the benefit of this disclosure will readily appreciate that any suitable container type can benefit from corner structures as disclosed herein. Moreover, those skilled in the art will readily appreciate that while containers with four corners are shown and described herein, any suitable corner count in a container, e.g. an octagonal container with eight corners, or any other number of corners, can be adapted from the corner structures disclosed herein without departing from the scope of this disclosure. For example, if the minor end flaps are divided into multiple panels, they can be wrapped around an octagonal container's corners. In another example, if the minor end flaps are divided into multiple panels, they can be triangulated to form triangular corner posts in each corner.

The methods and systems of the present disclosure, as described above and shown in the drawings, provide for stackable containers with strong corners for improved resistance to failure when stacking relative to traditional corner configurations. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a container comprising:

a base having a first pair of opposed base edges and a second pair of opposed base edges;

two first sidewall structures, each first sidewall structure foldably attached to one of the first base edges; and two second sidewall structures, each second sidewall structure foldably attached to one of the second base edges by a fold line having a fold line width, wherein each of the second sidewall structures comprises:

a first wall panel foldably attached to one of the second base edges along a first fold line, a second wall panel foldably attached to the first wall panel configured to be overlapped with the first wall panel to form a side wall, and a first minor end flap foldably attached to the first wall panel extending in a lateral direction from the first wall panel, and a second minor end flap foldably attached to the second wall panel extending in the lateral direction from the second wall panel, configured to overlap the first minor end flap and one of the first sidewall structures in forming a corner of a container formed from the blank, wherein the second minor end flap is foldably attached to the second wall panel by a crushed channel having a crushed channel width, wherein the crushed channel width is greater than the fold line width, wherein the crushed channel is devoid of die cut outs, perforations, slits, fold lines, score lines, or lines of weakness beyond the crushed state of the crushed channel itself.

2. The blank as recited in claim 1, further comprising:

an adhesive adhered to the first wall panel and first minor end flap, wherein the second wall panel is folded over and adhered by the adhesive to the first wall panel, wherein the second minor end flap is adhered to the first minor end flap, and wherein the crushed channel is adhered to at least one of the first minor end flap and the first wall panel.

3. The blank as recited in claim 1, wherein the first and second minor end flaps are attached to one another by a frangible connection configured to maintain contact between the first and second minor end flaps for at least a portion of an erecting process forming the blank into a container.

4. The blank as recited in claim 1, wherein the first and second minor end flaps are attached to one another by a crushed portion.

5. The blank as recited in claim 1, wherein the first and second wall panels are foldably attached across a line that includes at least one slit portion and at least one crushed portion.

6. The blank as recited in claim 5, wherein the first and second wall panels are foldably attached across a line of alternating slit portions and crushed portions.

7. The blank as recited in claim 6, wherein the crushed portions extend in a crushed portion length direction and have a crushed portion width in a lateral direction relative to the crushed portion length direction, wherein the crushed channel extends along a crushed channel length and the crushed channel width, wherein the crushed channel width is defined in a direction lateral relative to the crushed channel length, wherein the crushed channel width is wider than the crushed portion width.

8. The blank as recited in claim 1, wherein the second wall panel includes at least one index flap defined therein, and wherein at least one indexing aperture is defined in the base aligned with the at least one index flap for stacking.

9. The blank as recited in claim 1, wherein the base, first sidewall structures, and second sidewall structures are all defined in a sheet of corrugated paper having a corrugated thickness and including at least one corrugated layer of paper material, an inner layer of paper material, and an outer layer of paper material, wherein in the crushed channel, the layers of paper material are compacted together to a crushed thickness that is thinner than the corrugated thickness.

10. The blank as recited in claim 9, wherein the sheet of corrugated paper defines at least one fold line, wherein the fold line extends along a fold line length and fold line width is defined in a direction lateral to the fold line length, wherein the crushed channel defines a crushed channel length and a crushed channel width is defined in a direction lateral to the crushed channel length, wherein the crushed channel width is wider than the fold line width.

11. The blank of claim 1 wherein the first minor end flap is a single flap and the second minor end flap is a single flap.

12. The container of claim 1 wherein the first minor end flap is a single flap and the second minor end flap is single flap.

13. A container comprising:

a base having a first pair of opposed base edges and a second pair of opposed base edges;

two first sidewall structures, each first sidewall structure foldably attached to one of the first base edges by a fold line having a fold line width; and two second sidewall structures, each second sidewall structure foldably attached to one of the second base edges, wherein the first sidewall structures and second sidewall structures define border that cooperates with the base to define an interior space configured for receiving product;

wherein each of the second sidewall structures comprises:

a first wall panel foldably attached to one of the second base edges along a first fold line, a second wall panel foldably attached to the first wall panel configured to be overlapped with the first wall panel to form a side wall, and a first minor end flap foldably attached to the first wall panel extending in a lateral direction from the first wall panel, and a second minor end flap foldably attached to the second wall panel extending in the lateral direction from the second wall panel, overlapping the first minor end flap and one of the first sidewall structures to define a corner of the border, wherein the second minor end flap is foldably attached to the second wall panel by a crushed channel having a crushed channel width, wherein the crushed channel width is greater than the fold line width, wherein the crushed channel is devoid of die cut outs, perforations, slits, fold lines, score lines, or lines of weakness beyond the crushed state of the crushed channel itself.

14. The container as recited in claim 13, further comprising:

an adhesive adhered to the first wall panel and first minor end flap, wherein the second wall panel is folded over and adhered by the adhesive to the first wall panel, wherein the second minor end flap is adhered to the first minor end flap, wherein the crushed channel is adhered to at least one of the first minor end flap and the first wall panel, and wherein the first and second minor end flaps are overlapped with and adhered to one of the fist side wall structures.

15. The container as recited in claim 13, wherein the first and second minor end flaps are attached to one another by a frangible connection configured to maintain contact between the first and second minor end flaps for at least a portion of an erecting process forming a blank into the container.

16. The container as recited in claim 13, wherein the first and second wall panels are foldably attached across a line that includes at least one slit portion and at least one crushed portion.

17. The container as recited in claim 16, wherein the first and second wall panels are foldably attached across a line of alternating slit portions and crushed portions.

18. The container as recited in claim 17, wherein the crushed portions extend in a crushed portion length direction and have a crushed portion width in a lateral direction relative to the crushed portion length direction, wherein the crushed channel extends along a crushed channel length and the crushed channel width, wherein the crushed channel width is defined in a direction lateral relative to the crushed channel length, wherein the crushed channel width is wider than the crushed portion width.

19. The container as recited in claim 13, wherein the second wall panel includes at least one index flap defined therein adhered to the first wall panel and extending proud of the first wall panel relative to the base, and wherein at least one indexing aperture is defined in the base aligned with the at least one index flap for stacking.

20. The container as recited in claim 13, wherein the base, first sidewall structures, and second sidewall structures are all defined in a sheet of corrugated paper having a corrugated thickness and including at least one corrugated layer of paper material, an inner layer of paper material, and an outer layer of paper material, wherein in the crushed channel, the layers of paper material are compacted together to a crushed thickness that is thinner than the corrugated thickness.

21. The container as recited in claim 20, wherein the sheet of corrugated paper defines at least one fold line, wherein the fold line extends along a fold line length and fold line width is defined in a direction lateral to the fold line length, wherein the crushed channel defines a crushed channel length and a crushed channel width is defined in a direction lateral to the crushed channel length, wherein the crushed channel width is wider than the fold line width.

* * * * *